US007249959B2

(12) United States Patent
Pettersson et al.

(10) Patent No.: US 7,249,959 B2
(45) Date of Patent: Jul. 31, 2007

(54) ELECTRONIC DEVICE, ACCESSORY FOR ELECTRONIC DEVICE AND SUPPORT ELEMENT

(75) Inventors: Juha-Pekka Pettersson, Kangasala (FI); Kari Lehtinen, Turku (FI)

(73) Assignee: Nokia Corporation, Espoo (FI)

( * ) Notice: Subject to any disclaimer, the term of this patent is extended or adjusted under 35 U.S.C. 154(b) by 567 days.

(21) Appl. No.: 10/029,908

(22) Filed: Dec. 21, 2001

(65) Prior Publication Data

US 2002/0085349 A1 Jul. 4, 2002

(30) Foreign Application Priority Data

Dec. 28, 2000 (FI) ..... 20002869

(51) Int. Cl.
*H01R 13/44* (2006.01)

(52) U.S. Cl. ..... 439/142; 439/929

(58) Field of Classification Search ..... 439/142, 439/144, 374, 929; 361/680–686
See application file for complete search history.

(56) References Cited

U.S. PATENT DOCUMENTS 5,882,220 A * 3/1999 Horri et al. ..... 439/297
6,108,200 A * 8/2000 Fullerton ..... 361/686
6,127,802 A * 10/2000 Lloyd et al. ..... 439/298
6,483,698 B1 * 11/2002 Loh ..... 439/142

FOREIGN PATENT DOCUMENTS

| | | |
|---|---|---|
| EP | 0 602 778 | 6/1994 |
| EP | 1 014 656 A1 | 6/2000 |
| FR | 2 762 739 | 10/1998 |
| WO | WO 96/10229 | 9/1995 |

* cited by examiner

*Primary Examiner*—Khiem Nguyen
(74) *Attorney, Agent, or Firm*—Perman & Green, LLP

(57) ABSTRACT

An electronic device, an accessory for an electronic device and a support element. The support element (15) is arranged to support the connection between an accessory connector (5) of the electronic device (1) and a connector (13) of the accessory (6). The support element (15) is fitted either to the electronic device (1) or to the accessory for the electronic device.

11 Claims, 2 Drawing Sheets

ELECTRONIC DEVICE, ACCESSORY FOR ELECTRONIC DEVICE AND SUPPORT ELEMENT

Figure 1A:
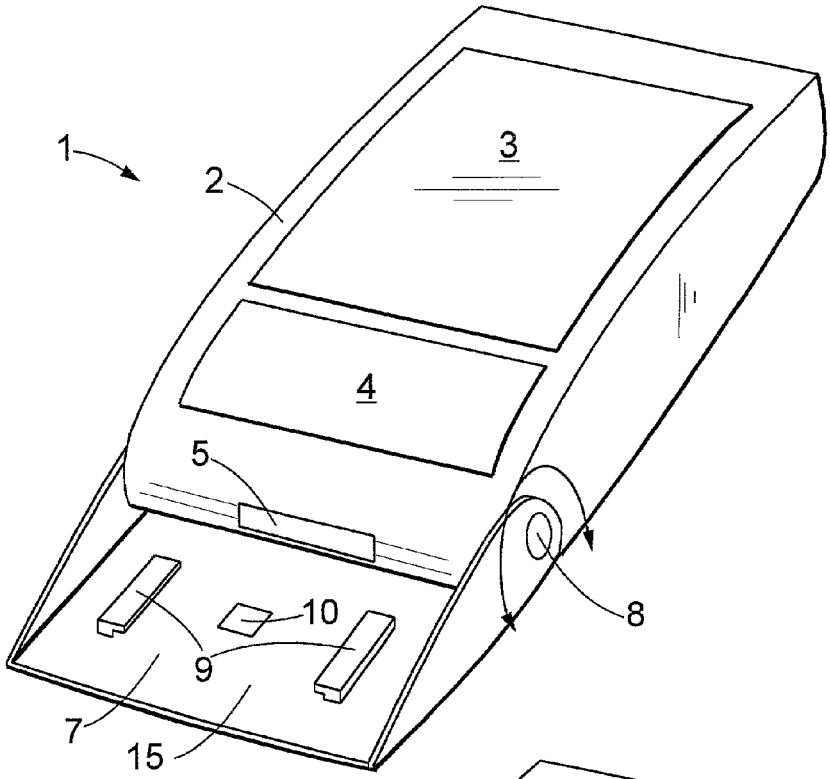

The invention relates to an electronic device comprising an accessory connector for connecting accessories to the device.

The invention also relates to an accessory for an electronic device, comprising a connector for connecting the accessory to an accessory connector of the electronic device.

The invention further relates to a support element.

Accessories like MP3 players, hands-free devices, scanners, radio receivers, bar code readers, additional keyboards, cameras and the like are known to be used in connection with mobile phones, communicators, portable computers or combinations thereof and other similar electronic devices. Accessories are usually connected to the accessory connector of a device with cables. The use of cables, however, often causes problems and is disadvantageous to the use of the device: cables get tangled easily and they get stuck in clothes or other external objects. In addition, cable connectors are quite subject to mechanical stress, which may, in the worst case, break the cable connector or even the accessory connector of the device.

It is also known that an accessory is connected without cables directly to an accessory connector. In this case, the accessory is supported by contact parts of the connector or possibly also by a locking part fitted in the connector. Alone the weight of the accessory causes mechanical stress for the connector; further, when accessories like additional keyboards are used, a rather great partial load is directed at the accessory connector. Mechanical stress weakens the operation of the connector and causes, for instance, contact problems and may sooner or later break the connector. Moreover, the accessory may give an impression of impaired quality, because it is insufficiently supported by the device.

The purpose of the present invention is to provide an electronic device, an accessory for an electronic device and a support element, by which the above problems can be avoided.

The electronic device of the invention is characterized in that the device comprises a support element which is arranged to support the accessory connected to the accessory connector.

The electronic device accessory of the invention is characterized in that the accessory comprises a support element which is arranged to support the accessory to the electronic device when the connector is connected to the accessory connector.

The support element of the invention is characterized in that it is arranged to support an accessory connector of an electronic device and a connector of an accessory, which are connected to each other.

The essential idea of the invention is that the connection between the accessory connector of the electronic device and the connector of the accessory is supported by the support element. Furthermore, the idea of a preferred embodiment is that the support element is fitted in the electronic device. The idea of another preferred embodiment is that the support element is arranged detachably in the device. The idea of a third preferred embodiment is that the support element is fitted to an accessory of the electronic device.

The invention provides the advantage that the support element supports the device and the accessory to one another, and no significant mechanical stress is directed to the connectors of the device and accessory. The use of the accessory connected to the device is comfortable and reliable, which gives a better impression of the quality of the device. It is easy to connect the accessory to the device and, correspondingly, to disconnect it from the device. No cables are required for connecting the accessory to the device.

Figure 1B:
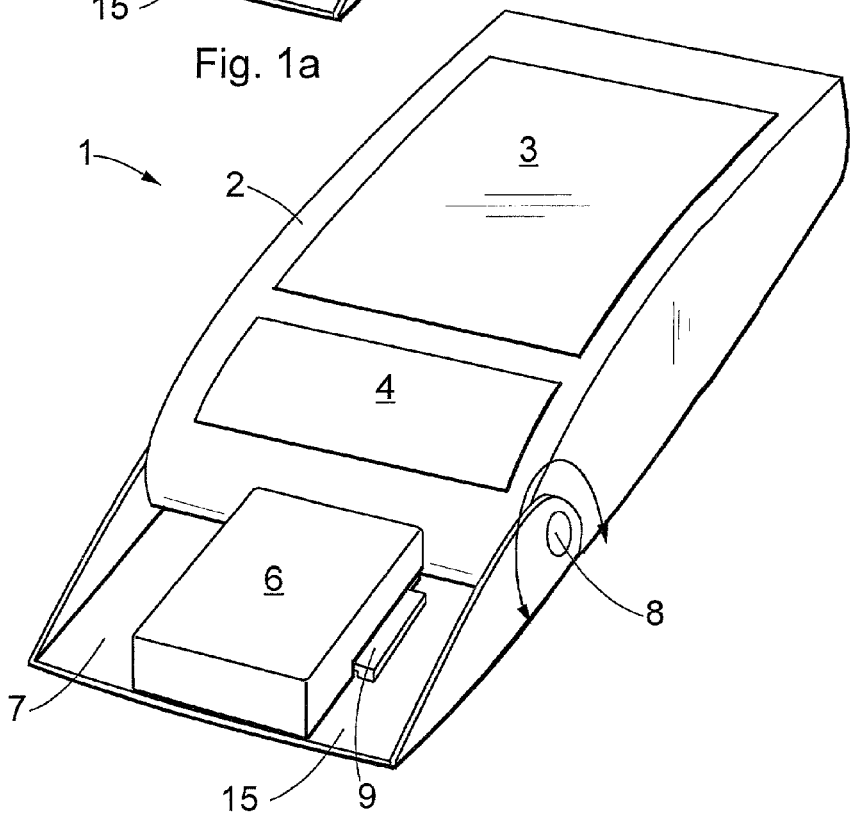
Figure 2:
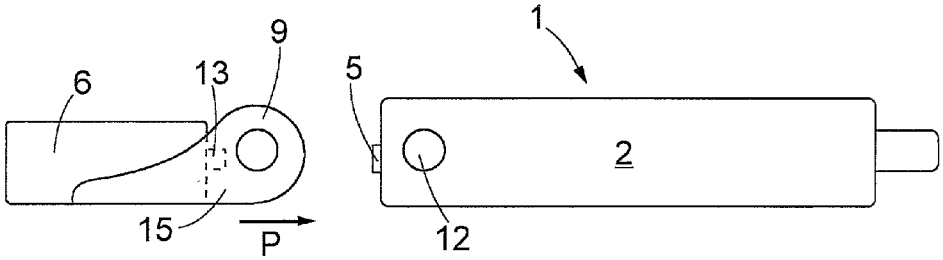
Figure 3:
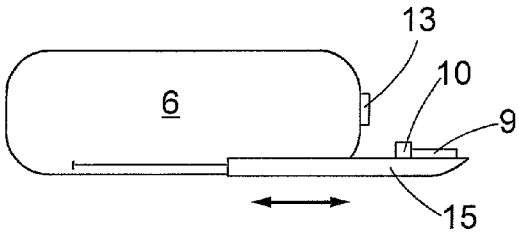
Figure 4:
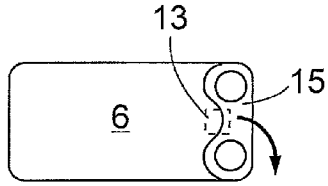
Figure 5:
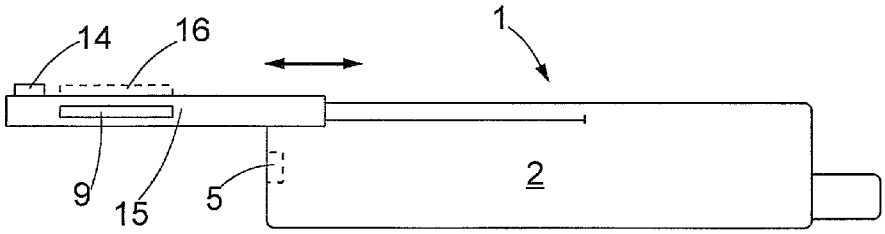

The invention will be described in greater detail in the attached drawings in which FIG. 1*a* is a schematic perspective view of an embodiment of an electronic device according to the invention, FIG. 1*b* shows a schematic perspective view of the embodiment of the electronic device of FIG. 1*b*, and an accessory fitted in an accessory connector of the device, FIG. 2 is a schematic side view of an embodiment of an accessory according to the invention, FIG. 3 is a schematic side view of a second embodiment of the accessory according to the invention, FIG. 4 is a schematic side view of a third embodiment of the accessory according to the invention, and FIG. 5 is a schematic side view of a second embodiment of the electronic device according to the invention.

FIGS. 1*a* and 1*b* are schematic perspective views of an embodiment of an electronic device 1 according to the invention. In this application, the electronic device 1 refers, for example, to mobile phones, communicators, portable computers or combinations thereof or the like. They are devices known per se by a person skilled in the art, and therefore they are not described herein in greater detail.

The electronic device 1—hereinafter the device 1—comprises a base part 2, at which at least one display 3 and a keyboard 4 are typically arranged. The device 1 also comprises at least one accessory connector 5, to which accessories 6 like an MP3 player, hands-free device, scanner, radio receiver, bar code reader, additional keyboard, camera or the like which are to be connected to the electronics of the device 1, are connected. Typically there are also other connectors, such as a recharging connector, in the device 1. All external connections of the device can also be integrated into one connector. The connector can be an electrical, IR or optical connector. The device 1 comprises a lid 7, which is fixed to the base part 2 of the device so that it turns round hinges 8, the lid being shown in FIGS. 1*a*, 1*b* in an open position. The lid 7 can be turned onto the base part 2, whereby operating keys 4 and/or the display 3 are covered by it. The lid 7 is provided with fastening elements 9, to which accessories 6 mentioned above can be fastened detachably. The lid 7 may also be provided with operating keys, a display or other components known per se. When the device is in its operating position, the lid 7 is usually fastened to the lower part of the base part 2 of the device, as in FIGS. 1*a* and 1*b*, but the lid may also be fastened to the upper part or to the side of the base part 2.

In FIG. 1*b*, an accessory 6 is fastened to the fastening elements 9, and a connector of the accessory is connected to the accessory connector 5. The shape of the accessory 6 is shown only by way of example, and the shape of different accessories varies considerably. At that end of the accessory 6 which is arranged against the base part 2 of the device there is a connector, which, when being connected to the accessory connector 5 of the device, connects the electronics of the accessory 6 to the electronics of the device 1. It is to be noted that the connector of the accessory 6 is not shown in FIG. 1*b*, but it is, however, connected to the accessory connector 5 of the device. The accessory connector 5 of the device and the connector of the accessory 6 are connectors known per se, and therefore their structure is not explained in more detail in this application.

In the embodiment of FIGS. 1*b*, 1*b*, the fastening elements 9 comprise two rail-like projections which are arranged substantially in the longitudinal direction of the device 1. Correspondingly, the accessory 6 is provided with counterparts to which the fastening elements 9 fit. The counterparts of the accessory 6 are fitted to the fastening elements 9 by sliding. The fastening elements 9 can naturally be implemented by another structure known per se.

The lid 7 also comprises locking elements 10 which lock the accessory 6 fastened to the fastening elements 9 and connected to the accessory connector 5 to its place in respect of the device 1. The locking elements 10 can also be fitted in the fastening elements 9. The locking elements 10 are implemented in a manner known per se by a person skilled in the art, and therefore their structure and operation are not explained in greater detail herein.

The lid 7 is a support element 15, which supports the accessory 6 connected to the accessory connector 5 to the device 1. Since the support element 15 is arranged substantially at a distance from the accessory connector 5, the support element 15 provides the accessory 6 with a firm support. It is easy to keep the accessory 6 connected to the device 1, because no cables are required and because the accessory 6 stays firmly in place and is supported by the support element 15. The stability of the connection reduces mechanical stress directed at the connector of the accessory and the accessory connector 5 substantially. The accessory 6 is easy to fasten to the fastening elements 9 and, if required, to disconnect from the fastening elements 9.

In a preferred embodiment of the invention, the support element 15 can be detached from the base part 2 of the device, and, if required, the accessory 6 can first be fastened to the detached support element 15 and the entity consisting of the support element 15 and the accessory 6 can then be fastened to the base part 2 of the device and to the accessory connector 5.

The support element 15 can be implemented without fastening elements 9, in which case the support element 15 supports the accessory 6 by means of its surfaces which are formed so as to be suitable for this purpose. The support element 15 can also be implemented without locking elements 10, the locking being arranged in the accessory connector 5, for instance, or the locking elements can also be fitted elsewhere in the base part 2 of the device.

FIG. 2 is a schematic side view of an embodiment of the accessory according to the invention. The selection of accessories for the device 1 includes accessories 6 with a support element 15. The support element 15 is provided with fastening elements 9 for fastening the support element 15 and the accessory 6 to the counterparts 12 in the electronic device. In the embodiment shown in FIG. 2, the support element 15 comprises lugs arranged on both sides of the accessory 6, the lugs being provided with the fastening elements. The support element 15 can naturally have a different shape and a different location: what is essential is that it is provided with fastening elements which may be fastened to the device 1 when the connector 13 of the accessory is connected to the accessory connector 5. The connector 13 of the accessory is pushed in the direction shown by arrow P to the accessory connector 5 of the device, and simultaneously the fastening elements 9 are fastened to the counterparts 12. The support element 15 supports the device 1 and the accessory 6 connected to the accessory connector 5 of the device, so that no substantial load is directed to the accessory connector 5 and the connector 13. When the accessory 6 connected to the device 1 is replaced by another, the support element 15 is replaced, too. The support element 15 can also be detached from the accessory 6, whereupon different accessories 6 can be fitted to one and the same support element 15.

A lid or a similar element known per se can be fitted to the counterparts 12 of the device 1 when no accessory 6 according to the invention is connected to the device 1. A preferred embodiment of the invention is a support element 15, by which the original lid can be replaced in a device 1 to which a lid known per se has originally been fitted.

FIG. 3 is a schematic side view of a second embodiment of the accessory according to the invention. The accessory 6 comprises a support element 15 which can be moved substantially back and forth in the actual accessory part. When the accessory 6 is disconnected from the device, the support element 15 can be moved in its entirety to the side of the actual accessory, due to which the accessory 6 requires less space and is easier to carry. If the accessory 6 is fastened to the device, the support element 15 is brought to the open position shown in FIG. 3, and the fastening elements 9 can be fastened to the counterparts in the device. The support element 15 also comprises locking elements 10, by which the support element 15 is locked to the device.

FIG. 4 is a schematic side view of a third embodiment of the accessory of the invention. The support element 15 is arranged turnably at the accessory 6. When the accessory is not connected to the device, the support element 15 can be turned to the position shown in FIG. 4, and the connector 13 of the accessory 6 remains under the support element 15, where it is protected from dust and impurities.

FIG. 5 is a schematic side view of a third embodiment of the electronic device according to the invention. The support element 15 is a lid moving slidably along the base part 2 of the device 1. The fastening elements 9 for the accessory are arranged on the sides of the support element 15. When an accessory is connected to the device 1, the support element 15 is first brought to the open position shown in FIG. 5, whereafter the accessory 6 is fastened to the fastening elements 9 and the connector of the accessory is fitted into the accessory connector 5. The slidably moving support element 15 can also be detachable from the device 1, in which case the accessory can first be fastened to the detached support element 15, and then the support element 15 and the accessory are brought to their places in the base part 2. Components 14 of the device, such as a microphone, loudspeaker or the like, can also be fitted to the support element 15. Also the accessory connector can be fitted to the support element 15.

When the accessory 6 need not be connected to the accessory connector 5, it can be arranged on the other side of the support element 15. The fastening elements 9 are shaped and located in such a manner that the accessory 6 arranged this way is reliably fastened to the support element 15. Thus, the accessory 6 can easily be carried with the device 1, either in a way that the support element 15 is in the open position shown in the figure, or that it is placed onto the base part 2 of the device. The support element 15 can also be provided with another set of fastening elements 16, to which the portable accessory 6 can be fastened and whereby only the accessory 6 to be connected to the accessory connector 5 is fastened to the fastening elements 9.

The drawings and the related description are only intended to illustrate the idea of the invention. In its details, the invention may vary within the scope of the claims. Consequently, the device 1 may comprise one or more support elements 15. The same device 1 can be provided with accessories 6 by means of a support element 15 which is fitted either to the device 1 or to the accessory 6. The accessory connector 5 can also be fitted to the support element 15, in which case the signals between the accessory 6 and the device 1 are transmitted by hinges of the support element 15, for instance.

The invention claimed is:

1. A system for connecting an accessory to an electronic device comprising:

an electronic device having a first connector for operationally attaching an accessory thereto;

an accessory having a second connector for operational connection to the electronic device through the connector of the electronic device; and a support element mounted on one of said electronic device or said accessory for supporting the accessory on the electronic device when it is in operational connection to the electronic device through the first and second connectors, and wherein the support element further comprises a locking element for securing the accessory to the support element.

2. The system of claim 1 wherein the support element is constructed with attachment elements for removably securing the accessory thereon.

3. The system of claim 2 wherein the attachment elements comprise rails, said rails constructed to receive the accessory in a sliding motion.

4. The system of claim 1 wherein the support element is moveably attached to the electronic device.

5. A system for connecting an accessory to an electronic device comprising:

an electronic device having a connector for operationally attaching an accessory thereto;

an accessory having a connector for operational connection to the electronic device through the connector of the electronic device; and a support element mounted on one of said electronic device or said accessory for supporting the accessory when it is in operational connection to the electronic device, wherein the support element is mounted for sliding or pivotal motion on the electronic device.

6. The system of claim 1 wherein the support element is removably attached to the electronic device.

7. The system of claim 1 wherein the support element is mounted on the accessory and the support element is constructed for removable attachment to the electronic device.

8. An electronic device constructed for receiving an accessory in operational connection comprising:

a base part; and a support element mounted on the base part in a position to support the accessory on the electronic device, when the accessory is in operational connection to the electronic device.

9. The electronic device of claim 8 wherein the support element is mounted on the base part for movement from a first position to a supporting position.

10. An accessory device constructed for operational connection to an electronic device comprising:

a body part; and a support element mounted on the body part in a position to support the accessory on the electronic device, when the accessory is in operational connection to the electronic device.

11. The accessory device of claim 10 wherein the support element is constructed for removable attachment to the electronic device when the accessory is in operational connection to the electronic device.

* * * * *